US011148761B2

(12) United States Patent
Farmer

(10) Patent No.: US 11,148,761 B2
(45) Date of Patent: Oct. 19, 2021

(54) BAR LOUNGER

(71) Applicant: Smoker Craft, Inc., New Paris, IN (US)

(72) Inventor: Michael Farmer, New Paris, IN (US)

(73) Assignee: SMOKER CRAFT, INC., New Paris, IN (US)

( * ) Notice: Subject to any disclaimer, the term of this patent is extended or adjusted under 35 U.S.C. 154(b) by 0 days.

(21) Appl. No.: 16/751,401

(22) Filed: Jan. 24, 2020

(65) Prior Publication Data

US 2020/0239112 A1 Jul. 30, 2020

Related U.S. Application Data

(60) Provisional application No. 62/796,239, filed on Jan. 24, 2019.

(51) Int. Cl.
*B63B 29/04* (2006.01)
*A47C 13/00* (2006.01)

(52) U.S. Cl.
CPC ..... *B63B 29/04* (2013.01); *A47C 13/00* (2013.01); *B63B 2029/043* (2013.01); *B63B 2029/046* (2013.01)

(58) Field of Classification Search
CPC ... B63B 29/04; B63B 29/06; B63B 2029/043; B63B 2029/046; A47C 13/00
USPC ..... 297/121
See application file for complete search history.

(56) References Cited

U.S. PATENT DOCUMENTS

| | | | | | |
|---|---|---|---|---|---|
| 1,890,129 | A * | 12/1932 | Nanine | A47C 13/00 | 297/121 |
| 4,211,449 | A * | 7/1980 | Richardson | A47C 13/00 | 297/126 |
| 4,854,261 | A * | 8/1989 | Goldsmith | B63B 29/04 | 114/363 |
| 4,924,798 | A * | 5/1990 | Lathers | B63B 29/04 | 108/124 |
| 6,065,422 | A * | 5/2000 | Davidson | B63B 29/04 | 114/363 |
| 7,281,487 | B1 * | 10/2007 | Placek | B63B 17/00 | 114/343 |
| 8,616,143 | B2 * | 12/2013 | Hancock, Jr. | B63B 19/12 | 114/363 |
| 10,577,057 | B1 * | 3/2020 | Hull | B63B 34/26 | |
| 10,604,217 | B2 * | 3/2020 | Curts | B63B 32/70 | |
| 2005/0011430 | A1 * | 1/2005 | Blaisdell | B63B 17/00 | 114/361 |
| 2006/0048694 | A1 * | 3/2006 | Forbes | B63B 29/04 | 114/363 |

(Continued)

*Primary Examiner* — Mark R Wendell
(74) *Attorney, Agent, or Firm* — Woodard, Emhardt, Henry, Reeves & Wagner, LLP

(57) ABSTRACT

A convertible seating system is disclosed including a base and a first seating component supported by the base. The first seating component includes a first table portion extending from the first seating component, and optionally also a first footrest. The seating system further includes a second seating component including a second table portion and defining a footrest. The seating components are independently convertible from a seating position to a table position. When both seating components are in the seating position, a continuous seating surface is formed. When both seating components are in the table position, a continuous table surface is formed.

11 Claims, 6 Drawing Sheets

(56) References Cited

U.S. PATENT DOCUMENTS

| | | | | |
|---|---|---|---|---|
| 2008/0196649 | A1* | 8/2008 | Kalil | B63B 19/14<br>114/201 R |
| 2008/0223261 | A1* | 9/2008 | Frederick | A47B 13/003<br>108/44 |
| 2010/0319604 | A1* | 12/2010 | Mayrand | B63B 29/02<br>114/363 |
| 2016/0229496 | A1* | 8/2016 | Foss | B63B 29/10 |
| 2016/0264217 | A1* | 9/2016 | Heimerl | B63B 29/04 |
| 2017/0225752 | A1* | 8/2017 | O'Neal | B63B 29/06 |

* cited by examiner

BAR LOUNGER

CROSS-REFERENCE TO RELATED APPLICATION

This application claims the benefit of U.S. Provisional Application No. 62/796,239 filed Jan. 24, 2019, which is hereby incorporated by reference.

FIELD

This disclosure is in the field of seating systems which are convertible to provide alternate arrangements of tables and/or seats. In one aspect, the convertible seating systems are particularly useful for boats and other vehicles.

BACKGROUND

There is value in having seating systems which are convertible to various arrangements in order provide more flexibility of use. For example, for boats there may be a variety of uses intended for the boat, requiring different seating arrangements. Thus, there may be a desire for additional lounging area in some instances. At other times, additional table space with upright seating may be needed. Providing a seating system that converts between lounging and table seating can satisfy both needs. Specific to boats, this solves the issue for those who want a bar seating style boat, but who also are interested in a lounger boat. Conversely, someone that wants primarily a lounger may still on occasion want to be able to seat more people in a bar-type setting.

In an exemplary embodiment, the disclosed seating system may alternate between a single or double wide lounger on the one hand at times, and a bar or pub style table with four bar stools at other times. In short, the lounger allows for a configuration having a center bar layout or a double lounger layout.

SUMMARY

A convertible seating system is provided including a base and a first seating component supported by the base. The first seating component includes a first table portion extending from the first seating component, and optionally also a first footrest. The seating system may further includes a second seating component including a second table portion. The seating components are independently convertible from a seating position to a table position. When both seating components are in the seating position, there is preferably provided a continuous seating surface. When both seating components are in the table position, there is preferably provided a continuous table surface.

It is an object to provide a convertible seating system comprising individual seating components which may be configured alternately in either a seating arrangement or a table arrangement.

A further object is to provide a convertible seating system in which two seating components provide a continuous seating surface when both seating components are in a seating position, and a continuous table surface when both seating components are in a table position.

Further object and advantages will be apparent from the disclosure herein.

DESCRIPTION

Figure 1:
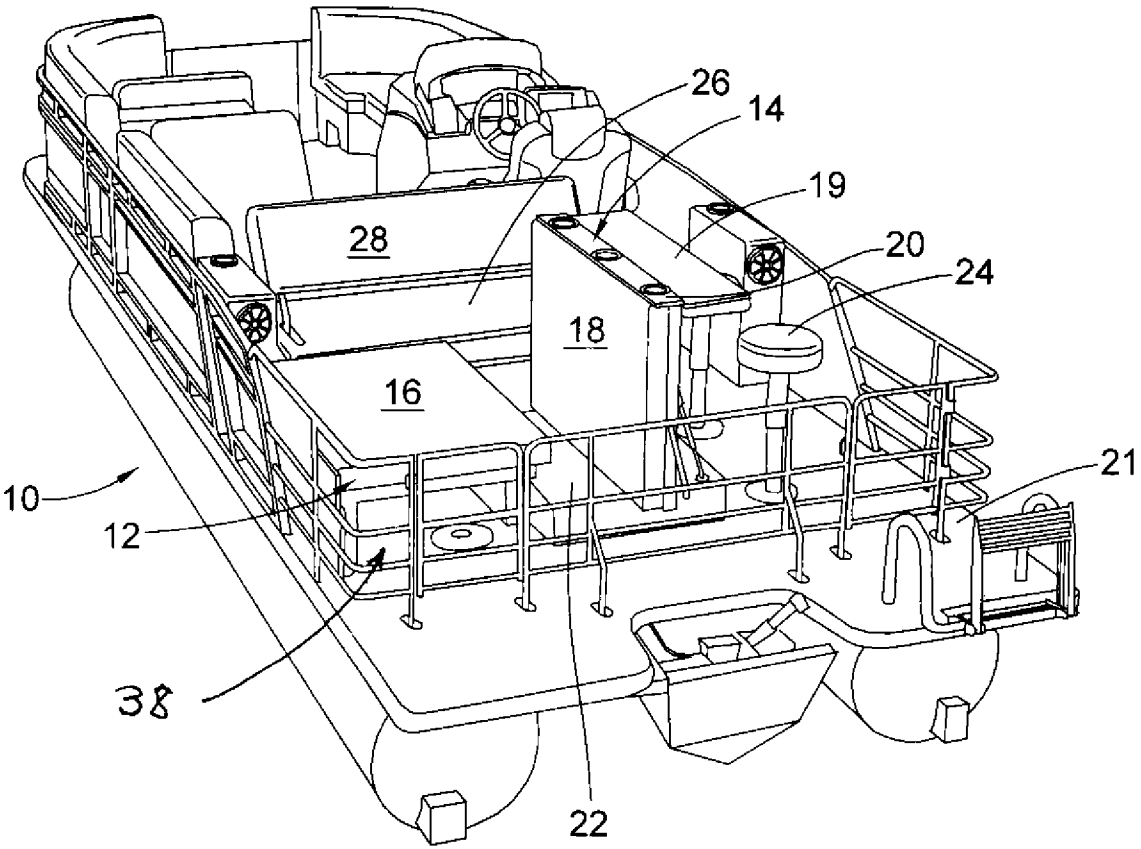
FIG. 1 is a perspective view of a boat comprising an embodiment of a lounger as disclosed and claimed herein, the lounger having a first seating component shown in a seating arrangement and a second seating component shown in a table arrangement.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

The present application discloses a seating system that is convertible between two different arrangements. In one arrangement, the system provides a double-wide lounger with an extended seating surface and a backrest. In the other arrangement, the system provides a table and optional seating surrounding it. The system may therefore be characterized as being convertible from providing a large seating area, e.g., a lounger, to providing a table top, e.g., bar with surrounding seating. For convenience, the overall, convertible seating system is referred to herein as simply the "lounger", which term is intended to encompass the seating system in all of its seating arrangements.

Referring to FIG. 1, there is shown a convertible lounger 10 in accordance with an embodiment of the present invention. Lounger 10 as shown comprises a first seating component 12 and a second seating component 14. The seating components are both movable between two positions. First seating component 12 is shown in a seating position with a first seating portion 16 facing upward, away from base 22. First seating component 12 also includes a first table portion 17 which is not visible in FIG. 1.

A second seating component 14 defines both a second seating portion 18 and a second table portion 19. As shown in FIG. 1, the table portions may include auxiliary features, such as cup holders 20. Second seating portion 19 has first and second ends. Second table portion 19 extends from the first end of the second seating portion 18. Second seating component 14 is shown in a table position with the second seating portion 18 extending vertically and the second table portion 19 facing upward, away from base 22. When the first and second seating components are both in the seating position, there is preferably formed a continuous seating surface. When the first and second seating components are both in the table position, there is preferably formed a continuous table surface. As described herein, provisions may be included to facilitate the movement of the seating components between the seating and table positions.

The lounger is shown in FIG. 1 as a component of a pontoon boat 21. The lounger has particular application in vehicles, particularly boats, where it is important to have components which may be firmly anchored in selected position. The lounger is shown as including a supporting base 22. The base may be integral with the lounger to form a modular unit which may be attached to an existing boat surface. However, it will be appreciated that the base may instead constitute the boat surface itself. It will also be appreciated that the lounger may be used with a variety of other types of boats, or even other types of vehicles.

The lounger may also comprise one or more separate seats 24. The seats are removably attached to the base, or the boat serving as the base. In this manner, seats 24 may be removed when seating components 12, 14 are both in the seating positions. On the other hand, when either or both of the seating components are in the table position, as shown in FIG. 1 for seating component 14, then the seats may be installed. One or both of the seating components are conveniently designed to form cavities that may receive the removed seats when the seating components are in the seating position.

Another option is the inclusion of a third seating component 26. As shown, the third seating component is preferably positioned to form a continuous surface with the first and second seating components when they are in the seating position, as shown with respect to first seating component 12 in FIG. 1. Also shown is an optional backrest 28. The backrest may have a first position tilted in a position, e.g., toward the rear of the boat, to serve primarily as a backrest for third seating component 26. Alternatively, the backrest may have a second position tilted in the opposite direction, e.g., away from the rear of the boat as shown in FIG. 1, to serve primarily as a backrest for one or both of the first and second seating components, as shown for example in FIG. 1 with respect to first seating component 12.

Figure 2:
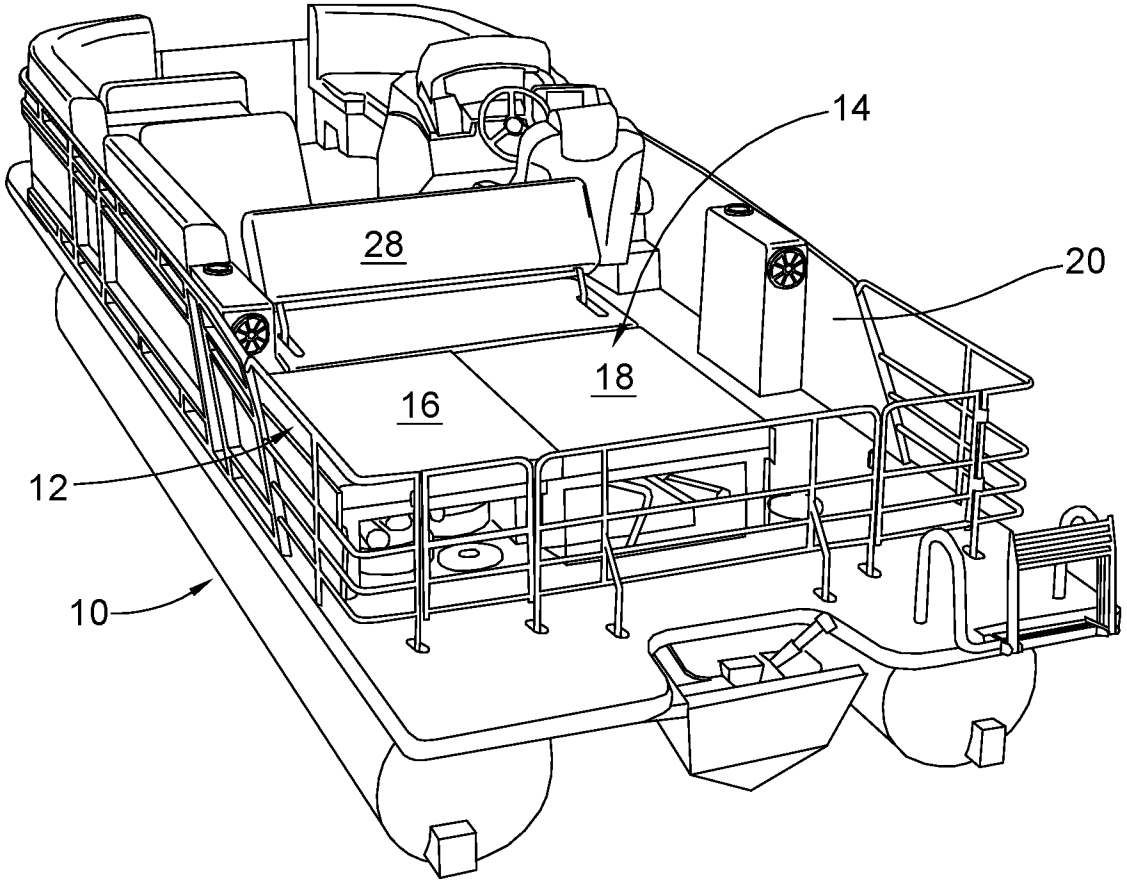
FIG. 2 is a perspective view of the boat and lounger of FIG. 1, showing both seating components in a seating arrangement and forming an extended seating surface with a backrest.
Figure 3:
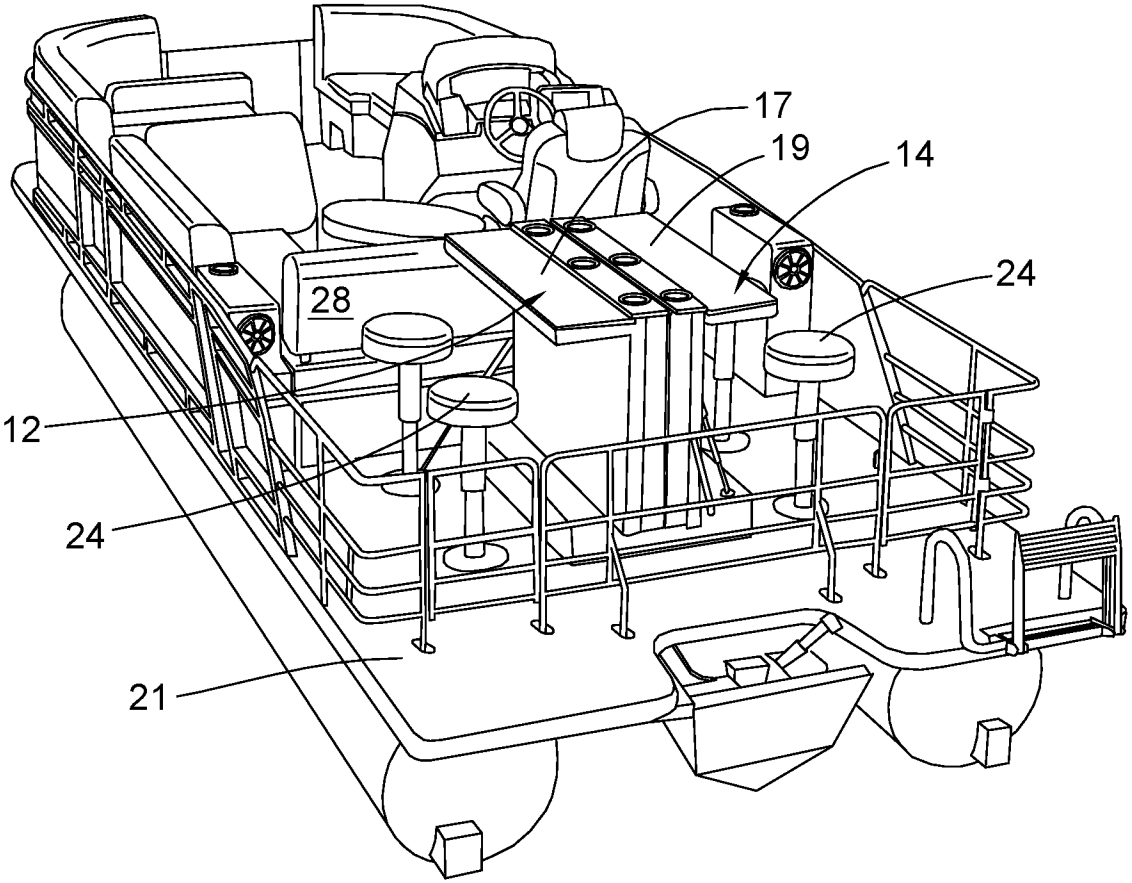
FIG. 3 is a perspective view of the boat and lounger of FIG. 1, showing both seating components in a table arrangement.

Alternative layouts are shown in FIGS. 2 and 3. Second seating component 14 has a second seating position supported by base 22 with the second seating portion 18 facing away from base 22. In FIG. 2, both seating components 12, 14 are in the seating position. It is apparent that the seating portions of the seating components 12 and 14 form a continuous seating surface with each other and with third seating component 26. Further, backrest 28 is then tilted, e.g., away from the rear of the boat, and the result is a double side lounger with a backrest. In FIG. 3, there is provided a plan view showing both the first and second seating components 12, 14 in the table position. In this configuration, the first and second table portions 17, 19 form a continuous table surface surrounded by four seats, e.g., bar stools, 24. Backrest 28 is then tilted, e.g., toward the rear of the boat, to serve as a backrest for third seating component 26.

Figure 4:
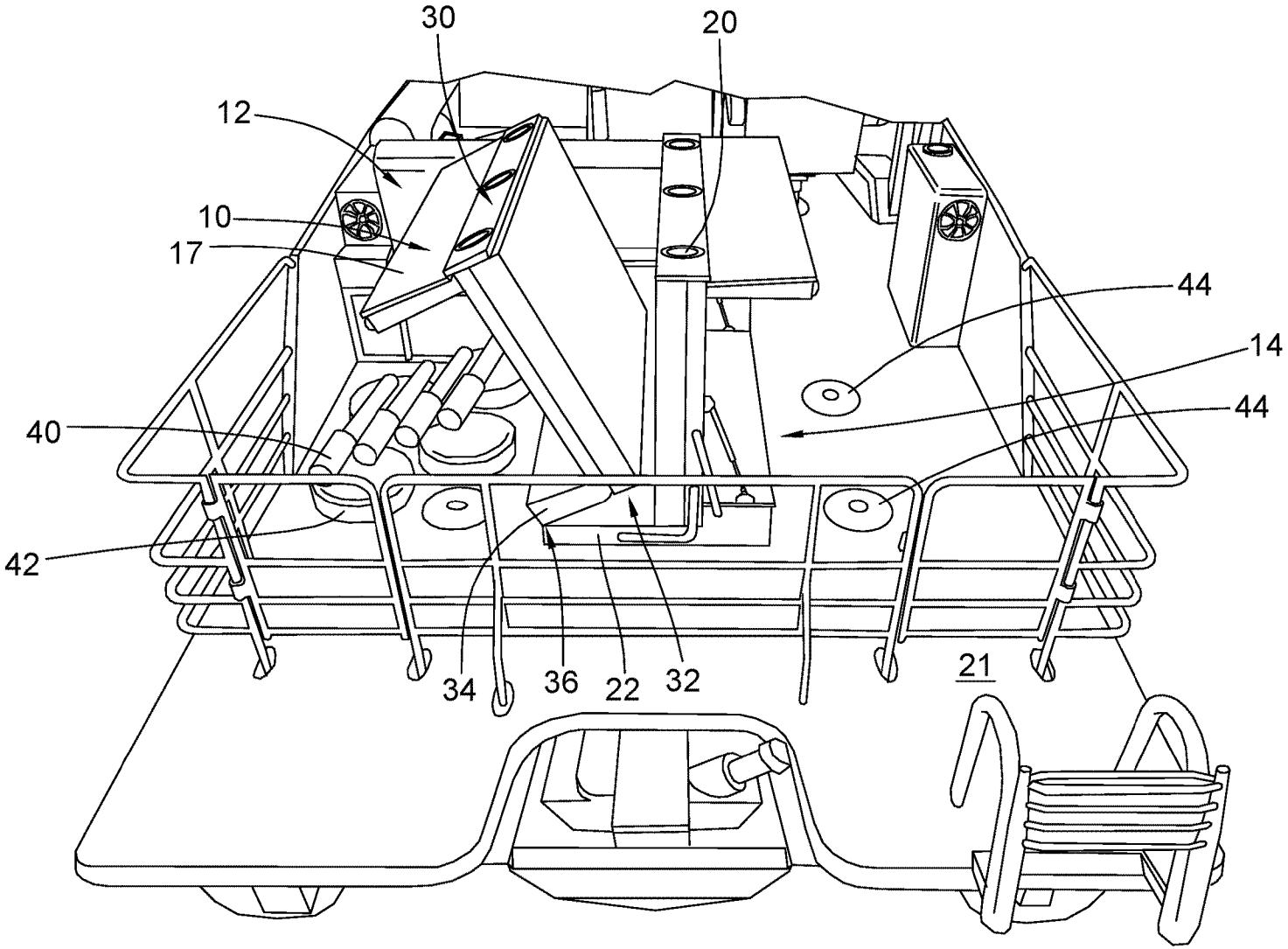
FIG. 4 is an end, perspective view showing components of the boat and lounger with one of the seating components in a partially-rotated position from a table arrangement and the other seating component in the full table position.

In FIG. 4 there is shown a lounger 10 showing the first seating component 12 in a slightly rotated position and the second seating component 14 in a vertical position. First seating portion 16 of first seating component 12 has a first end 30 and a second end 32. First table portion 17 extends from the first end 30 of first seating component 12. First seating component 12 further includes a first footrest portion 34 extending from the second end of first seating component 12 in the same direction as first table portion 17. Also referring to FIG. 4, second seating component 14 is shown attached to base 22 and in the second table position. In this position, second seating component 14 is supported by base 22 with second table portion 18 facing away from base 22.

A hinge 36 secures first seating component 12 to base 22. First seating component 12 pivots about hinge 36 between the first seating position and the first table position. In particular, hinge 36 secures first footrest portion 34 to base 22. First seating component 12 defines a cavity 38 between first table portion 17 and first footrest portion 34 on what is the underside of the first seating component 12 when it is in the first seating position. As shown, cavity 38 is sized to allow for storage of items therein.

In an embodiment, the lounger includes seats 24 removably secured to base 22, or a separate support surface, such as boat 21. For example, seats 24 may comprise support poles 40 and sitting members 42, e.g., bar stool seats. In use, support poles 40 are received in mounting members 44 secured to base 22 or boat 21. Support poles 40 extend upwardly from mounting members 44 and removably receive bar stool seats 42. When not in use, support poles 40 are detached from the support surface and seats 42 are removed therefrom. These separate components may then be stored within cavity 38 when the first seating component 12 is in the first seating position.

Figure 5:
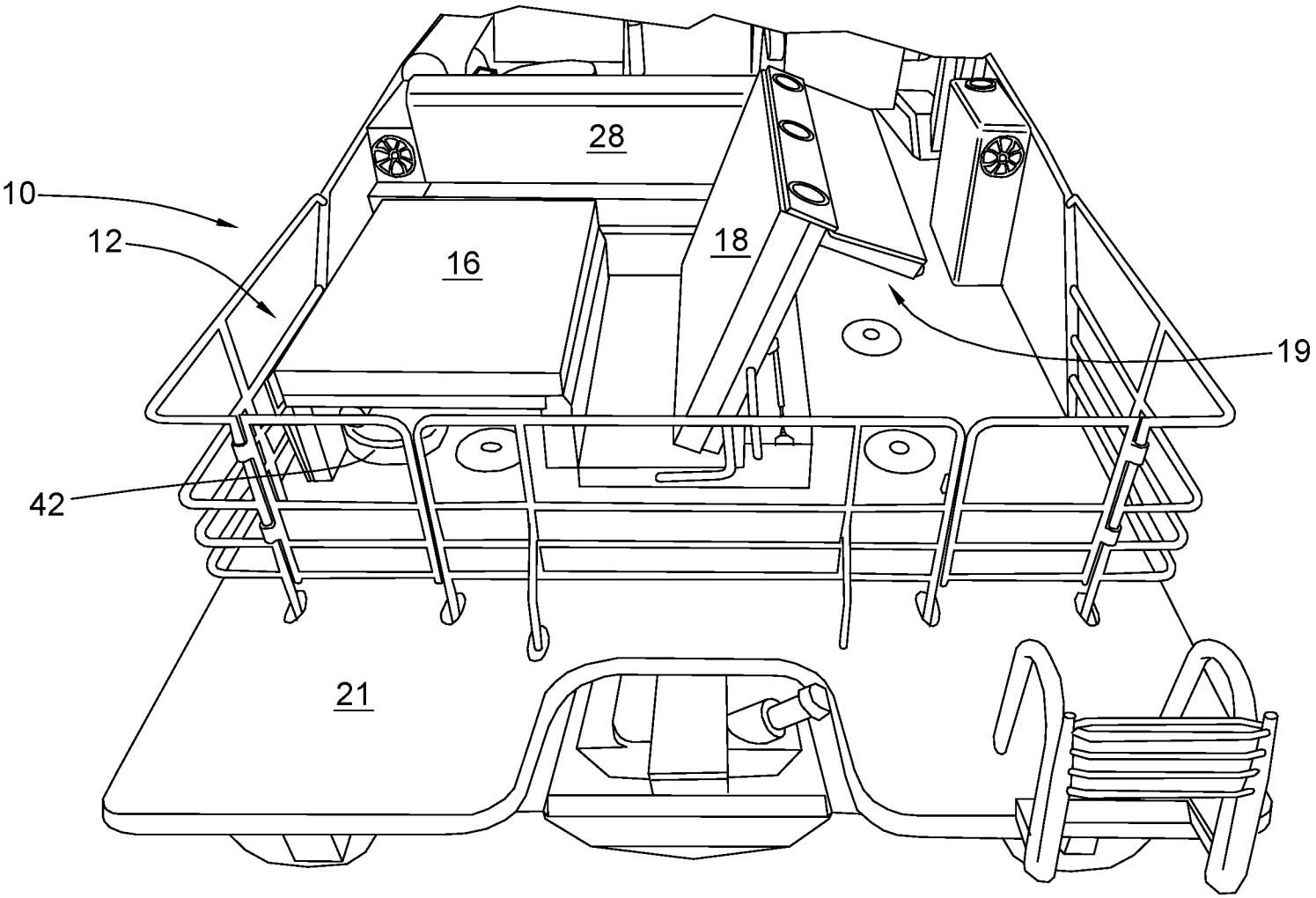
FIG. 5 is an end, perspective view showing components of the boat and lounger with one of the seating components in a full seating arrangement and the other seating component in a partially-rotated position from a table arrangement.

In FIG. 5, the lounger is shown with the first seating component 12 fully in the first seating position, and the second seating component 14 partially rotated from the second table position. It is desired that the first and second seating portions 16, 18 define a continuous seating surface when both are in the seating position. This may be accomplished, for example, by one or more linkages coupling second seating component 14 with base 22.

Figure 7:
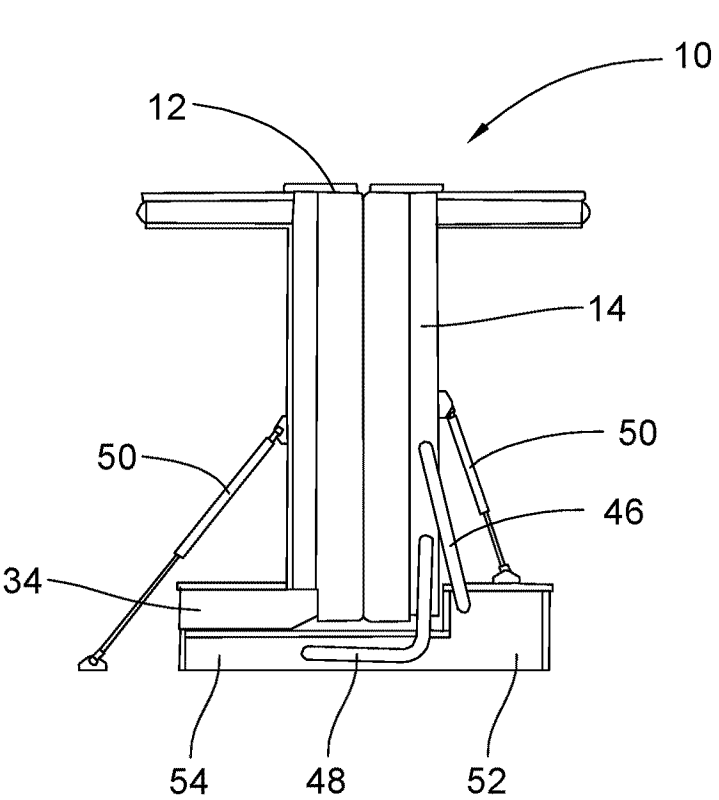
FIG. 7 is an end, elevational view of the lounger seating components as shown in FIG. 6.
Figure 6:
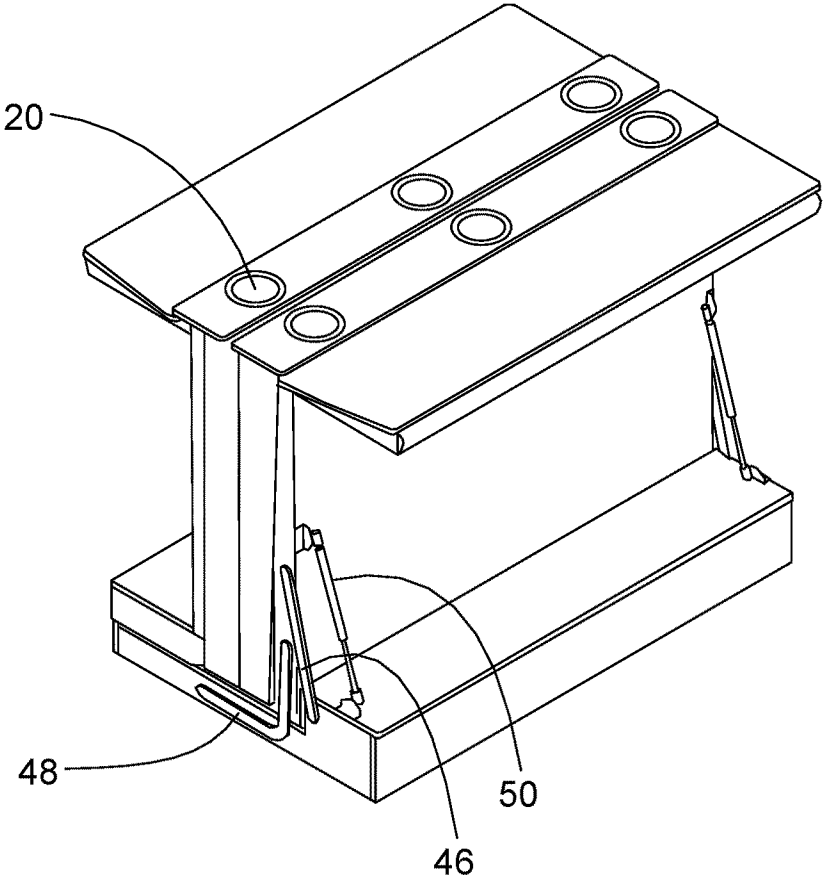
FIG. 6 is a perspective view showing the first and second seating components and including details of linkages securing the second seating component to the base.

Referring to FIGS. 6 and 7, first linkage 46 and second linkage 48 are shown. The linkages attach between second seating component 14 and base 22. The linkages are configured to cause second seating component 14 to move laterally toward first seating component 12 upon rotation of second seating component 14. This results in the first and second seating portions being moved together such that a continuous seating surface is provided when both seating components are in their respective seating positions.

As also shown in FIGS. 6 and 7, linkages 46, 48 are preferably provided as pairs of linkages positioned on opposite sides of the seating components to provide greater strength and stability upon rotation of the seating components. Gas strut brackets 50 may be included.

FIG. 7 shows additional details for the first footrest portion 34 and a second footrest portion 52. First footrest portion 34 is provided as only a portion of the vertical height of the footrest. Base 22 includes an underlying portion 54 which supports the first footrest portion 34 when first seating component 12 is in the first table position. By comparison, base 22 includes the second footrest portion 52 rather than the second seating component forming the second footrest portion.

Many variations of the described lounger may be employed without deviating from the present invention. For example, the lounger has been described as including various components such as hinges and linkages to facilitate movement of the seating components between a seating position and a table position. It will be appreciated, however, that various other conventional components may be used for this purpose, or that such components may be eliminated and the seating components manipulated independently of the base and/or of each other.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

REFERENCE NUMBERS

10 lounger
12 first seating component
14 second seating component
16 first seating portion
17 first table portion
18 second seating portion
19 second table portion
20 cup holder
21 pontoon boat
22 base
24 seat
26 third seating component
28 backrest
30 first end of 16
32 second end of 16
34 first footrest portion
36 hinge
38 cavity
40 support poles
42 sitting members
44 mounting members
46 first linkage pair
48 second linkage pair
50 gas strut brackets
52 second footrest portion
54 underlying portion of 22

The invention claimed is:

1. A convertible seating system comprising:

a base;

a first seating component having a first planar seat portion having first and second ends, the first seating component further defining a first planar table portion extending perpendicularly from the first end of the first seat portion;

a first support having first and second ends, the first end being attached to the second end of the first planar seat portion, the first support extending perpendicularly from the second end of the first seat portion;

a hinge connecting the support to the base, the first seating component having a first seating position supported by the first table portion and the first support on the base with the first seat portion facing away from the base, the first seating component having a first table position supported by the first support on the base with the first table portion facing away from the base;

a second seating component having a second planar seat portion having first and second ends, the second seating component further defining a second planar table portion extending perpendicularly from the first end of the second seat portion; and a second support having first and second ends, the first end being attached to the second end of the second seat portion; and at least one linkage connecting between the base and the second seating component, the second seating component having a second seating position supported by the second support and the second table portion on the base with the second seating portion facing away from the base, the second seating component having a second table position supported by the second support on the base with the second table portion facing away from the base, the linkage being configured to move the second seating component between the second seating position and the second table position;

the first and second seat portions together forming a continuous surface when the first and second seating components are in the first and second seating positions, and the first and second table portions together forming a continuous surface when the first and second seating components are in the first and second table positions.

2. The seating system of claim 1 in which, the first seating component pivots about the hinge between the first seating position and the first table position.

3. The seating system of claim 2 in which the first seating component further includes a first footrest portion extending from the second end of the first seating component in the same direction as the first table portion.

4. The seating system of claim 3 in which the hinge secures the first footrest portion to the base.

5. The seating system of claim 1 and further comprising:

a mounting member attached to the base; and a seat removably secured to and extending upwardly from the mounting member.

6. The seating system of claim 5 in which the first seating component defines a cavity opposite the first seating portion, the cavity being sized to receive the seat therein when the seat has been removed from the mounting member.

7. The seating system of claim 6 in which the seat comprises a pole and a sitting member removably attached to the pole, the cavity being sized to receive the pole and the sitting member when the sitting member has been removed from the pole.

8. The seating system of claim 1 in which the base is coupled with a boat.

9. The seating system of claim 1 and further comprising a third seating component having a third seating portion, the first, second and third seating portions forming a continuous surface when the first and second seating components are in the first and second seating positions.

10. The seating system of claim 9 and further including a movable backrest having first and second positions, the backrest in the first position forming a backrest for the third seating portion, the backrest in the second position forming a backrest for the first and second seating portions.

11. The seating system of claim 10, the backrest being positioned in the first position when the first and second seating components are in the first and second table positions, the backrest being positioned in the second position when the first and second seating components are in the first and second table positions.

* * * * *